US006383567B2

(12) United States Patent
Ager et al.

(10) Patent No.: US 6,383,567 B2
(45) Date of Patent: May 7, 2002

(54) MULTIPLE CUT TO CORE TAPE ROLL

(75) Inventors: Ronald H. Ager, North Augusta (CA); Daniel M. Puls; Gerald L. Vogler, both of Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/843,960

(22) Filed: Apr. 27, 2001

Related U.S. Application Data

(63) Continuation of application No. 08/970,638, filed on Nov. 14, 1997, now abandoned.

(51) Int. Cl.[7] ..... B05D 1/32

(52) U.S. Cl. ..... 427/282; 428/136; 428/906; 83/907; 83/909; 82/47; 82/46; 82/101; 242/166; 242/522; 242/525; 156/543; 156/577; 156/554; 118/505; 118/504

(58) Field of Search ..... 428/136, 906; 83/907, 909; 82/47, 46, 101; 242/166, 522, 525; 156/543, 577, 554; 427/282; 118/505, 504

(56) References Cited

U.S. PATENT DOCUMENTS

| | | | | |
|---|---|---|---|---|
| 1,950,738 A | | 3/1934 | Mills | 242/525 |
| 2,250,774 A | | 7/1941 | Piller | 225/34 |
| 2,385,612 A | | 9/1945 | Cootlee | 242/166 |
| 3,174,368 A | * | 3/1965 | Best | 82/50 |
| 3,301,109 A | * | 1/1967 | Taverna | 82/47 |
| 3,350,026 A | | 10/1967 | Amos | 242/423 |
| 4,292,867 A | * | 10/1981 | Stoffels et al. | 82/47 |
| 5,453,070 A | | 9/1995 | Moody | 493/288 |

FOREIGN PATENT DOCUMENTS

WO WO 96/05107 2/1996

OTHER PUBLICATIONS

"Web Processing and Converting Technology and Equipment," edited by Donatas Satas, 1984 No month.

"Slitting Without Rewinding," Paper, Film and Foil Converter, Feb. 1965.

John Wiley & Sons, Inc., *The Wiley Encyclopedia of Packaging Technology*, 2nd Edition, edited by Aaron L. Brody and Kenneth S. Marsh, pp. 844–849 No date.

Lever 300, "3 Motor Heavy Duty Semi–Automatic Signle Knife Slitter with Automatic Gear Spacer," Lever Model SK–59, brochure. No date.

* cited by examiner

*Primary Examiner*—William P. Watkins, III
(74) *Attorney, Agent, or Firm*—Melissa E. Buss

(57) ABSTRACT

A roll of web and a method of making it has a total web width that is divided into n+1 portions by n circumferential slits. Each portion has a width less than the total web width such that the sum of the width of the portions equals the total web width and such that each portion can be individually used as an independent roll of web. The portions are held together such as by a core or an unslit portion of the web at innermost wraps of web.

15 Claims, 1 Drawing Sheet

MULTIPLE CUT TO CORE TAPE ROLL

CROSS REFERENCE TO RELATED APPLICATIONS

This application is a continuation of U.S. application No. 08/970,638, filed Nov. 14, 1997, now ABN.

TECHNICAL FIELD

The present invention relates to wound substrates. More particularly, the present invention relates to tape rolls.

BACKGROUND OF THE INVENTION

The job of masking a surface for painting often involves the use of several different widths of masking tape, such as for graphic designs on cars, trucks, or vans. This requires finding the different widths of tape or at least maintaining an inventory of the necessary widths of tape in a convenient location near the area where the taping is done. Some workers carry the rolls of tape that are not being used around their wrist. Independent of what system is used, effort must be taken to keep the right width convenient for masking the surface.

Also, while using masking tape to mask a surface for painting it may be necessary to use large amounts of a specific width tape, such as for an airplane or bus. Several rolls would be used to finish the masking process. For applications where extreme lengths of continuous tape are needed, level wound tape can be used. Level wound tape is great for mechanized systems because it can accommodate the spirally wrapped strands of level wound tape. For hand masking applications, a planetary wind, with the strand of tape always coming off the roll in the same location with respect to the edge of the core, is desired.

During the process of masking a surface for painting it may be necessary to set the roll of masking tape down on a bench or cart that is frequently covered with dust or dirt. Since the slit edges of a cell of masking tape are tacky on its sides, dirt or other contaminants can adhere to the side of the roll of tape. These contaminants stay with the tape until it is adhered to the surface. If the contaminants are not removed from the edge of the tape, they are coated during the painting process and become a defect along the paint line.

Also, there are roll stability problems during the manufacture of narrow width tapes, tapes up to 0.635 cm (0.25 in) wide. Telescoping occurs if the web is too tight, and peaking and gapping occur if the web is too loose.

During the packaging of narrow width tapes, large amounts of film are needed to wrap narrow rolls. The film wrap covers the periphery as well as the sides of the roll to protect all of the tape. One method of covering the roll is to use shrink film. During heating, significant forces are generated in the radial direction of the roll of tape. These forces can disfigure narrow rolls of tape.

SUMMARY OF THE INVENTION

The invention is a roll of web having a total web width that is divided into n+1 portions by n circumferential slits. Each portion has a width less than the total web width, and the sum of the widths of the portions equals the total web width.

The portions are held together. In one embodiment a core accomplishes this. In another embodiment an unslit portion of the web at the innermost wraps of web is used.

The portions can have the same or different widths. Either all of the portions can be used as independent rolls of web or the portions on the ends of the roll of web can form sacrificial edge portions. The roll of web can be adhesive tape used for masking.

The method of creating this roll of web includes winding a length of web into a roll having a total web width, circumferentially slitting the web to divide the roll of web into a plurality of portions having a width less than the total web width such that the sum of the width of the portions equals the total web width.

Before the winding step, the method can include slitting a jumbo roll of web into a plurality of webs having the total web width. The winding step can include winding the plurality of webs in a planetary fashion until the appropriate length of web is wound. Alternatively, the winding step, can include winding the length of tape into a log, with the width of the log being much greater than the total web width, and using lathe cutting.

DETAILED DESCRIPTION

The invention is a roll of a web that has multiple cuts to create, in effect, multiple rolls of the web on a single core. The invention can be applied to any type of wound web of material. In the illustrated embodiments, the wound web is a roll of tape, such as masking tape.

Figure 1:
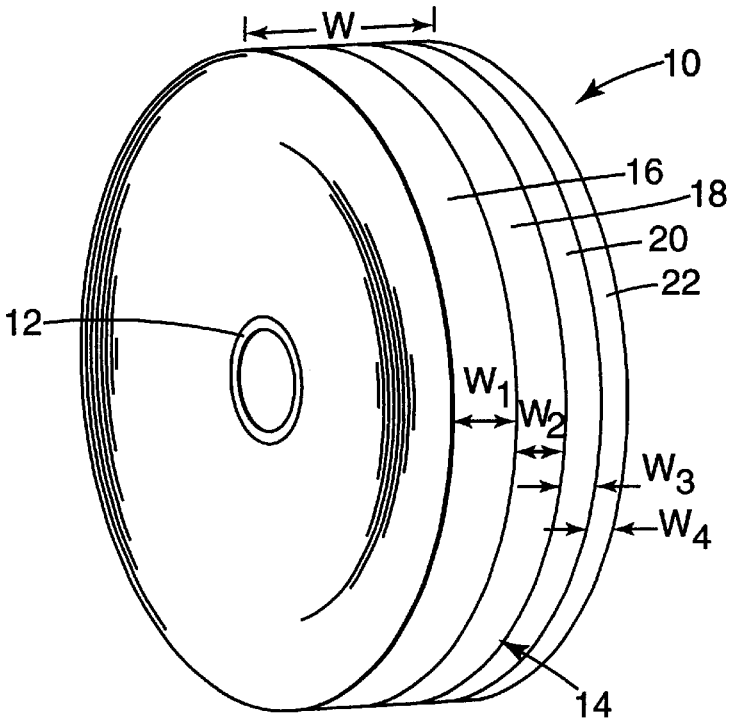
FIG. 1 is a perspective view of a cored tape roll of the present invention.

Referring to FIG. 1, the roll 10 of tape has a total tape width W. As shown, the tape is wound on a core 12. At least one circumferential slit 14 divides the roll of tape into a first portion 16 and a second portion 18. (FIG. 1 shows three slits 14 which divide the tape into a first portion 16, a second portion 18, a third portion 20, and a fourth portion 22.) The first portion 16 has a width $w_1$ less than the total tape width W, the second portion 18 has a width $w_2$ less than the total tape width W, the third portion 20 has a width $w_3$ less than the total tape width W, and the fourth portion 22 has a width $w_4$ less than the total tape width W. The widths $w_1$, $w_2$, $w_3$, and $w_4$ of the first, second, third, and fourth portions 16, 18, 20, 22 can be the same or different from each other. Any combination of similar or different widths can be used. Regardless, the sum of the widths of the various portions equals the total tape width W.

As shown, the roll of tape can have more than one slit 14 to the core. Any number n of circumferential slits 14 can be used to divide the tape into n+1 portions of tape. Each portion can be individually used as an independent roll of tape. Also, the outermost portions (the first portion 16 and the fourth portion 22 in FIG. 1) can be used as sacrificial edge portions. These edge portions would not be used. With adhesive tapes, and particularly with masking tapes, dirt and debris collects on the edges of the tape. By creating a thin sacrificial edge portion, the contaminants and debris that can collect on the edges of the tape adhere to the sacrificial edge portions. These sacrificial edge portions are not used for masking, thereby preventing defects in the painted object.

Figure 2:
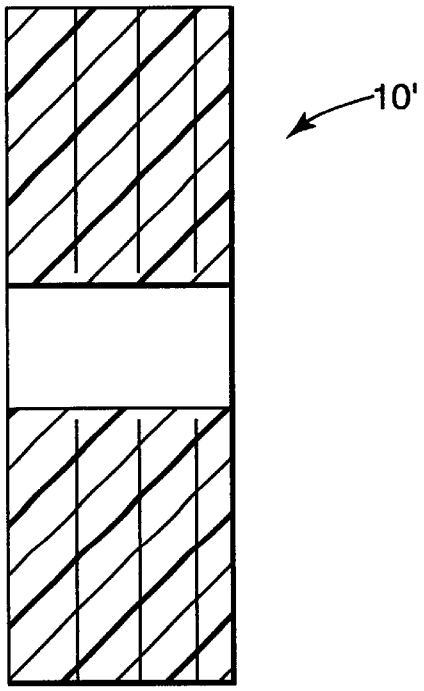
FIG. 2 is a cross-sectional view of a coreless tape roll of the present invention.

The various portions are held together. In the embodiment of FIG. 1, the core 12 is used for this purpose. When a core is used, the circumferential slits 14 can extend through the entire roll 10 of tape to the core 12, with the core remaining functionally unslit. (Although in some slitting operations the core may be scored, it is not slit and it is preferred that no scoring of the core occur.) In an alternative embodiment, shown in FIG. 2, a coreless roll 10' of tape is made with multiple portions. In this embodiment, the innermost wraps of tape can remain unslit to hold together the portions of tape.

Optionally, the roll 10 of tape can include an inner core (not shown) around which the roll 10 of tape on the core 12 is rotatable. This would permit the roll 10 of tape to be used on a dispenser. In this embodiment, the outer core 12 would be completely slit, permitting the portions on the roll 10 to independently rotate on the inner core. A roll of tape that has at least two different strand widths, that is wound on an inner core, could be used on a dispenser.

The tape roll of this invention has numerous advantages over the known slit through the core tape rolls. In shipping and storing these known tape rolls, much less packaging material is required because two or more "rolls" of tape are connected to each other and can be packaged together. Packaging wider rolls is less expensive and easier, particularly when shrink wrapping or bagging individual rolls. This invention has multiple strands of tape on the same core requiring less protective wrap to fully cover the tape when compared to protecting individual rolls, particularly where the film wrap covers the periphery of the roll as well as the sides of the roll such that all of the tape is protected. Counterintuitively and surprisingly, it takes less packaging and is more efficient in production to package the wider roll of the present invention (with multiple side-by-side winds) than one roll of narrower tape! This is due in part because the wider rolls have more structural integrity. Also, the tape roll of the present invention does not have the telescoping and related roll instability problems commonly associated with narrower width rolls. One method of covering the roll is to use shrink film. During the heating process significant forces are generated in the radial direction of the roll of tape. These forces can disfigure narrow rolls of tape. This invention has multiple strands of tape on the same core which reinforce adjacent strands giving the roll more structural integrity, thus minimizing the opportunity for the roll to become distorted during the shrink wrap process.

The cores 12 can be plastic but the present invention need not use plastic cores. Strong cores can be obtained by fiber cores which are less expensive than plastic cores.

Moreover, with the tape roll of this invention with, for example, three side-by-side winds of tape, three times as much tape can be stored on a single roll. There is much more tape on a single roll. A user will not run out of tape as fast as with conventional tape rolls. There are fewer rolls to be misplaced or lost (because multiple width portions obviate the need for separate tape rolls with different width tapes).

The invention can be made using rewind slitting or lathe slitting. Before slitting, pressure sensitive tapes and other web materials are frequently wound into large jumbo rolls at the end of coating or processing lines. The jumbo roll is a convenient form to handle large amounts of web material in the plant. The jumbo roll is generally much wider than the final tape width and is much longer than on the final product. The end user generally requires only a small part of the jumbo roll. Hence, the large jumbo roll is converted into smaller rolls using a variety of slitting processes. Two of these converting methods are rewind slitting and lathe slitting. Rewind slitting is discussed in "Web Processing and Converting Technology and Equipment" edited by Donatas Satas, 1984 as well as other references. Lathe slitting is compared to rewind slitting in "Slitting Without Rewinding" an article in Paper, Film and Foil Converter February 1965.

Rewind slitting involves unwinding the large jumbo roll, passing the web through a bank of knives that slit the web to the appropriate width, and winding the narrow webs in a planetary fashion on respective cores. (In a coreless method of winding the narrow rolls a slip sheet is placed on the core mandrel and tape is wound on the slip sheet.) This process continues until the appropriate length of material is wound on the core. At that time, the web is slit in the cross web direction, the cores with tape on them are removed, and new cores are placed on the core bar.

When using rewind slitting care is taken to separate the web after the bank of knives, where it is slit, to ensure the web is completely slit through so adjacent rolls of product do not fuse to each other due to weaving of the webs. One method of doing this is to put the cores on two different core bars and separate the strands such that the odd numbered strands go on one bar and the even numbered strands go to the other bar. If only a single core bar is used, then the web is separated, after the knife, in the cross web direction and the product is wound on separate cores. This is acceptable when the jumbo roll is slit into a small number of rolls. If a larger number of rolls is needed, it becomes untenable due to the skewing of the web for the outside rolls, which would cause wrinkles in the rolls.

Rewind slitting of narrow rolls of tape, up to 0.63 cm (0.25 in) wide, is difficult because of weaving and because it is difficult to maintain the structural integrity of the narrow roll of tape. Using rewind slitting to put multiple strands of tape adjacent to each other on a single core is difficult due to the weaving of the individual strands that causes them to become intertwined.

A second method of converting wide widths into narrow widths is lathe slitting. Lathe slitting of tape starts with winding an annulus of tape on a core, called a log. The log is made by winding the appropriate length of tape, generally the full jumbo roll width, on the core. The tape for the log can be from a jumbo roll or the log can be wound at the end of the coating process. The actual converting or slitting of the tape approximates the lathe processing of a cylinder of metal or wood. The log is spun around its axis and a knife penetrates the log in the radial direction until the tape and core are completely cut. The knife reverses and moves the appropriate amount (the width of the roll of tape) in the axial direction relative to the last cut and penetrates the log. At this point one roll of tape is slit from the log.

An example of making the roll of tape according to the invention uses lathe slitting. A length of tape is wound on a core for the desired length of tape. The core would be much wider than a single tape roll and will eventually form many rolls. The end of the long core plus a minimal amount of tape (containing the edge) is generally cut off and discarded as the weed roll. For subsequent tape rolls, the cut that severs a roll creates the first end of the next roll. So, for a particular roll (for this example presume that three 6 mm wide winds of tape are to be formed on an 18 mm wide core), an operator lathe cuts completely through all of the tape and the core. The blade is moved 6 mm and the tape is lathe cut through all (or most) of the tape but not the core. This forms a first portion of tape. Then the blade is moved 6 mm and the tape is lathe cut through all (or most) of the tape but not the core. This forms a second portion of tape and a third portion of tape. Then the blade is moved 6 mm and the tape is lathe cut through all of the tape and the core to sever the roll of tape from the remainder of the log core.

What is claimed is:

1. A method of masking an object with masking tape, comprising the steps of:

providing a roll of adhesive tape including n circumferential slits which divide the roll of tape into n+1 portions, and means for holding together the portions, wherein the adhesive tape comprises masking tape, and wherein the roll includes at least two outermost portions exposed to contaminants;

removing a length of tape from one of the portions of tape; and adhering the length of tape to an object to be masked and painted, wherein the length of tape is arranged so as not to present a contaminated portion along the paint line.

2. The method of claim 1, wherein there are at least three portions of tape, and wherein the portions include first and second outermost portions and at least a third portion between the outermost portions.

3. The method of claim 2, wherein the removing step comprises removing a length of tape from the third portion.

4. The method of claim 1, wherein the portions include first and second outermost portions, and a plurality of portions between the outermost portions.

5. The method of claim 4, wherein the removing step includes removing a length of tape from one of the portions between the outermost portions.

6. The method of claim 1, wherein the portions include first and second outermost portions, and a plurality of portions of different widths between the outermost portions.

7. The method of claim 6, wherein the removing step includes removing a length of tape from one of the portions between the outermost portions.

8. A method of claim 1, wherein the means for holding together comprises a core around which the tape is wound and wherein the circumferential slit extends through the entire roll of tape to the core with the core remaining functionally unslit.

9. The method of claim 1, wherein the means for holding together comprises an unslit portion of the tape at the innermost wraps of tape, wherein the unslit innermost wraps of tape are a minor portion of a total number of wraps of tape.

10. A method of masking an object with masking tape, comprising the steps of:

providing a roll of adhesive tape including n circumferential slits which divide the roll of tape into n+1 portions, and means for holding together the portions, wherein the adhesive tape comprises masking tape, and wherein the roll includes first and second sacrificial outermost portions exposed to contaminants, and at least one portion between the sacrificial outermost portions;

removing a length of tape from one of the portions of tape between the sacrificial portions; and adhering the length of tape to an object to be masked and painted.

11. The method of claim 10, wherein there are a plurality of portions of different widths between the outermost portions.

12. The method of claim 10, wherein the removing step includes removing a length of tape from one of the portions between the outermost portions.

13. The method of claim 10, wherein the means for holding together comprises a core around which the tape is wound and wherein the circumferential slit extends through the entire roll of tape to the core with the core remaining functionally unslit.

14. The method of claim 10, wherein the means for holding together comprises an unslit portion of the tape at the innermost wraps of tape, wherein the unslit innermost wraps of tape are a minor portion of a total number of wraps of tape.

15. A method of masking an object with masking tape, comprising the steps of:

providing a roll of adhesive tape including n circumferential slits which divide the roll of adhesive tape into n+1 portions, and an unslit portion of the roll of tape at the innermost wraps for holding together the portions, wherein the unslit innermost wraps of tape are a minor portion of a total number of wraps of tape, wherein the adhesive tape comprises masking tape, and wherein the roll includes first and second sacrificial outermost portions exposed to contaiminants, and a plurality of different width portions between the sacrificial outermost portions;

removing a length of tape from one of the portions of tape between the sacrificial portions; and adhering the length of tape to an object to be masked and painted.

* * * * *

UNITED STATES PATENT AND TRADEMARK OFFICE

CERTIFICATE OF CORRECTION

PATENT NO. : 6,383,567 B2
DATED : May 7, 2002
INVENTOR(S) : Ager, Ronald H.

It is certified that error appears in the above-identified patent and that said Letters Patent is hereby corrected as shown below:

Title page, Item [54] and Column 1, line 1,
Title, "MULTIPLE CUT TO CORE TAPE ROLL" should read -- MULTIPLE CUT TO CORE WEB ROLL --

Item [56], References Cited, OTHER PUBLICATIONS, "Signle" should read -- Single --;

Column 4,
Line 50, "long" should read -- log --
Line 51, "(containing the edge)" should read -- (containing the edge of the adhesive coat) --

Signed and Sealed this

Twenty-ninth Day of October, 2002

*Attest:*

*Attesting Officer*

JAMES E. ROGAN
*Director of the United States Patent and Trademark Office*